US006402768B1

(12) United States Patent
Liebel

(10) Patent No.: US 6,402,768 B1
(45) Date of Patent: Jun. 11, 2002

(54) DEVICE FOR CLEANING A HUMAN TONGUE

(76) Inventor: Gary M. Liebel, 1302 Old Meadow Rd., Pittsburgh, PA (US) 15241

( * ) Notice: Subject to any disclaimer, the term of this patent is extended or adjusted under 35 U.S.C. 154(b) by 0 days.

(21) Appl. No.: 09/516,692

(22) Filed: Mar. 1, 2000

Related U.S. Application Data

(63) Continuation-in-part of application No. 09/104,118, filed on Jun. 24, 1998, now Pat. No. 6,032,315.

(60) Provisional application No. 60/066,283, filed on Nov. 14, 1997, and provisional application No. 60/050,638, filed on Jun. 24, 1997.

(51) Int. Cl.[7] ..... A61B 17/24

(52) U.S. Cl. ..... 606/161; 15/236.01

(58) Field of Search ..... 606/161, 234; 15/160, 167.1, 22.1, 236.01, 236.07; 601/139; 132/308

(56) References Cited

U.S. PATENT DOCUMENTS

| | | | | | |
|---|---|---|---|---|---|
| 1,647,453 | A | | 11/1927 | Krantz | 15/167 |
| 1,891,864 | A | * | 12/1932 | Barrett | 606/161 |
| 3,254,356 | A | | 6/1966 | Yao et al. | |
| 3,943,592 | A | | 3/1976 | Bhaskar et al. | 15/160 |
| D243,422 | S | | 2/1977 | Varga | |
| 4,079,478 | A | | 3/1978 | Andrews, Sr. | |
| 4,455,704 | A | | 6/1984 | Williams | |
| 4,638,521 | A | | 1/1987 | Potente | 15/167.1 |
| D309,528 | S | | 7/1990 | Valenti | |
| D332,352 | S | | 1/1993 | Caldwell et al. | |
| 5,226,197 | A | | 7/1993 | Nack et al. | 15/111 |
| D354,624 | S | | 1/1995 | Gupta | |
| D367,707 | S | | 3/1996 | Baker | D4/104 |
| 5,511,273 | A | | 4/1996 | Carroll | |
| 5,613,262 | A | * | 3/1997 | Choy-Maldonado | 15/160 |
| 5,735,864 | A | | 4/1998 | Heisinger, Jr. | 15/111 |
| 5,749,116 | A | | 5/1998 | Wieder et al. | 15/160 |
| 5,778,477 | A | | 7/1998 | Conway | 15/167.1 |
| 5,792,159 | A | * | 8/1998 | Amin | 606/161 |
| 5,810,856 | A | * | 9/1998 | Tveras | 606/161 |
| 5,967,152 | A | * | 10/1999 | Rimkus | 132/308 |

* cited by examiner

*Primary Examiner*—Kennedy Schaetzle
*Assistant Examiner*—Kristen Droesch
(74) *Attorney, Agent, or Firm*—Webb Ziesenheim Logsdon Orkin & Hanson, P.C.

(57) ABSTRACT

A device for cleaning a tongue in the form of an elongated member including a head portion having a generally rectangular shape in plan view. A plurality of posts extends from a lower surface of the head portion wherein a total of a length of the posts plus a thickness of said head portion is less than about ¼ of an inch. An elongated, arcuate handle portion extends from the head portion and is aligned such that a longitudinal axis of the handle portion is transverse with a longitudinal axis of the head portion. The device may also include a lip downwardly depending from the front of the head portion to retain accumulated debris as the device is pulled along the tongue. The posts are preferably integrally molded with the head portion.

15 Claims, 4 Drawing Sheets

O
6'
2'
20
4'
B'
C'
E
7'
A'
2
D'
L'
8'
10'
H'
16'
18'
14'
12'

DEVICE FOR CLEANING A HUMAN TONGUE

CROSS REFERENCE TO RELATED APPLICATIONS

This application is a continuation-in-part of U.S. patent application Ser. No. 09/104,118, filed Jun. 24, 1998 now U.S. Pat. No. 6,032,315 which claims benefits to U.S. provisional application Serial No. 60/050,638, Jun. 24, 1997, which claims benefit to U.S. provisional application Serial No. 60/066,283, filed Nov. 14, 1997.

BACKGROUND OF THE INVENTION

My invention relates generally to the treatment and prevention of bad breath and, more particularly, to a device for cleaning odor causing debris from the human tongue. Various devices have been proposed heretofore in the form of tongue brushes, tongue scrapers, or combined toothbrushes and tongue cleaners, as exemplified by U.S. Pat. Nos. 4,455,704; 4,079,478; and 3,254,356. None of these devices have, to my knowledge, gained any widespread usage, perhaps due to their complexity of manufacture and/or ineffective operation.

My invention solves the problems encountered in prior tongue cleaning appliances by providing a tongue cleaning device which is both convenient to use and effective in results, while being economical to manufacture.

SUMMARY OF THE INVENTION

Briefly stated, my invention is directed to a device for cleaning the human tongue comprising a member having an elongated handle portion and a substantially rectangular head portion arranged transversely to the longitudinal axis of the handle portion. The head portion may be rectangular-shaped with rounded ends. The head portion may carry a plurality of bristles thereon, wherein the total thickness of the head portion and bristles is less than about ½ inch. The bristles may be nylon having a length of about ⅛ inch and clustered in groups or tufts. The tufts may also be provided as solid posts that are integrally molded with the head portion or integrally molded with a carrier plate which is, in turn, attached to the head portion. The head portion and posts preferably have an overall thickness of less than ¼ inch. The handle portion is formed to define an angle of about 10°–20° between the plane of the head portion and the longitudinal axis of the handle to better position the head portion relative to the tongue surface and to follow the convexity of the tongue at the rear of the mouth approaching the throat. The overall length of the device is about 5 to 5¼ inches.

The device also preferably carries a downwardly protruding lip along a leading edge of the head portion to act as a collector for debris dislodged by the bristles or the posts. The lip extends downwardly from the head portion a distance of about ⅛ inch, i.e., the same length as the bristles so as not to interfere with their cleaning action. The device permits the user to reach the back surface of the tongue due to its arcuate configuration and permits cleaning of the back surface without causing a gagging reflex due to its thin profile. Cleaning of the back surface of the tongue is especially important in eliminating halitosis or "bad breath".

These as well as other attributes and advantages of my invention will become better understood when reference is made to the appended drawings, taken with the following detailed description.

DETAILED DESCRIPTION OF THE INVENTION

Figure 1:
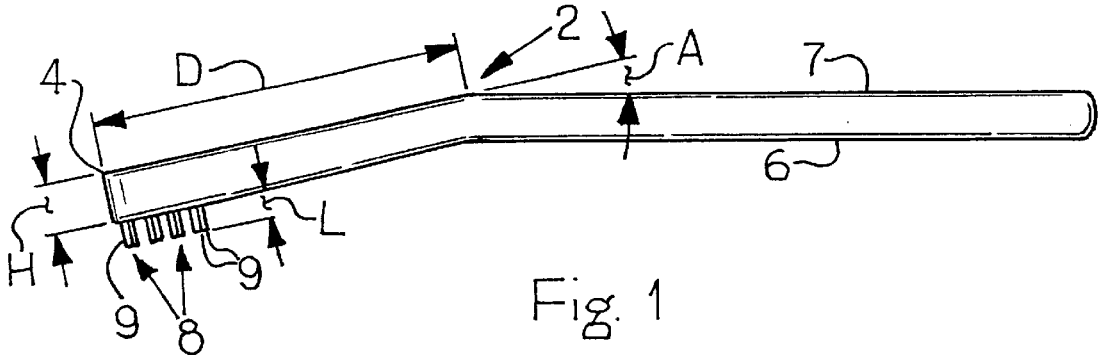
FIG. 1 is a longitudinal side view of a first embodiment of the tongue cleaning device of the present invention.

Reference will now be made to the drawings wherein identical elements are referred to by the same reference numerals throughout the various views and like elements are referred to by primed numerals.

Figure 2:
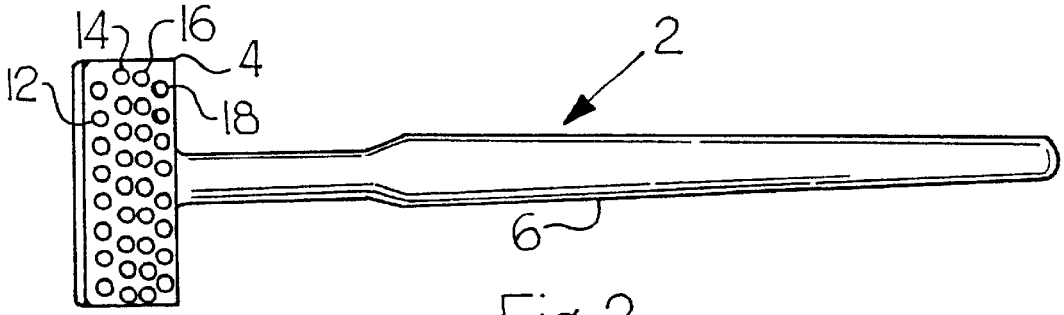
FIG. 2 is a bottom plan view of the device of FIG. 1.

The tongue cleaning device of the invention, generally designated 2, is in the form of an elongated member and includes a head portion 4 and a handle portion 6. The head portion 4 includes a plurality of bristle tufts 8. Each of the bristle tufts 8 is made up of a plurality of individual bristles 9. By way of example, the bristles 9 are made of nylon and are 0.006–0.007 in diameter. Each of the bristle tufts 8 consists of about 24–36 strands of bristles 9 measuring about ⅛ inch in diameter per bristle tuft 8. The ends of the bristle tufts 8 are flat and preferably lie in a common plane, which extends outwards from a bottom face of the head portion 4 a distance "L". Hence, "L" is the length of the bristle tufts 8 and the length of the individual bristles 9. The distance "L" is preferably about ⅛ inch. As can be seen in FIG. 2, the bristle tufts 8 in rows 12 and 14 and in rows 16 and 18 are offset from one another so as to ensure proper cleaning as the head portion 4 is moved in a direction coincident with the longitudinal axis of the handle 6. The distance between adjacent bristle tufts 8 is about 0.045 of an inch to avoid open spaces along the cleaning axis.

The overall height dimension "H" of FIG. 1 comprising the thickness of the head portion 4 and the length "L" is no greater than about ½ inch and, more preferably, no greater than about ⅜ inch. It is desirable to maintain a thin profile represented by dimension "H" so as to minimize or eliminate any possible gagging reflex when the head portion 4 is moved to the back of the tongue.

Figure 3:
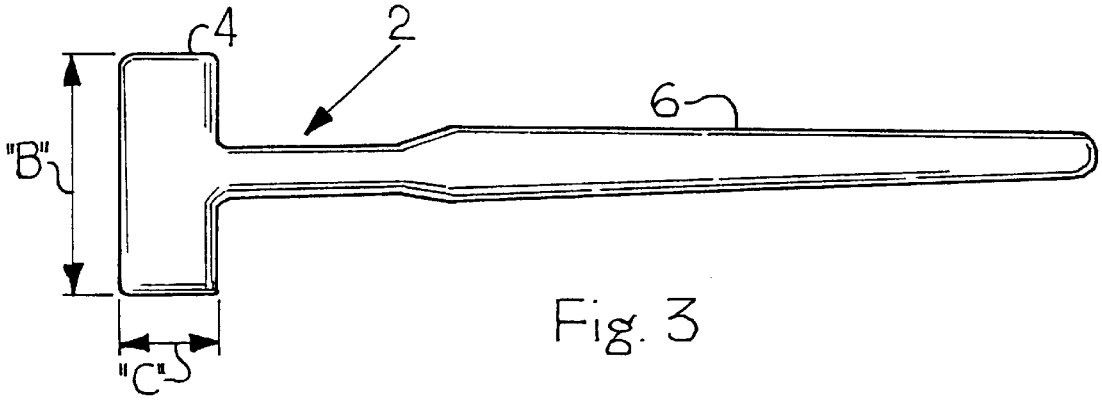
FIG. 3 is a top plan view of the device of FIG. 1.
Figure 4:
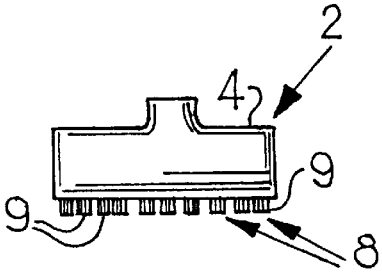
FIG. 4 is a front elevational view of the device of FIG. 1.

The head portion 4 is substantially rectangular in plan view and arranged such that the longitudinal axis of the head portion 4 is substantially perpendicular with the longitudinal axis of the handle portion 6. In this manner, the longer side (dimension "B" in FIG. 3) of the head portion 4 engages a substantial transverse dimension across the tongue surface. Dimension "B" defines the length of the head portion 4 and is preferably about 1¼ inches to about 1½ inches. The width of the head portion 4 identified as dimension "C" in FIG. 3 is about ½ inch, which is sufficient to accommodate the placement of the four rows 12, 14, 16 and 18 of bristle tufts 8 shown in FIG. 2. A presently preferred embodiment of my invention comprises two outer rows 12 and 18 containing eleven bristle tufts each and two inner rows 14 and 16 containing twelve bristle tufts each. This arrangement provides a sufficient number of rows (four) to assure proper loosening of foreign material from the tongue. In addition, the staggered or offset alignment between the bristle tufts 8 in rows 12 and 14 and between those in rows 16 and 18 ensure uniform bristle coverage along the length of the head portion 4 as the device 2 is moved by the user in a direction coincident with the longitudinal axis of the handle 6. The device 2 is inserted into the mouth and the bristle tufts 8 are placed against the back surface of the tongue and then pulled forward and then rinsed with water after each pass to remove collected debris. This procedure is repeated, preferably five to eight times, to ensure complete tongue cleaning.

Figure 5:
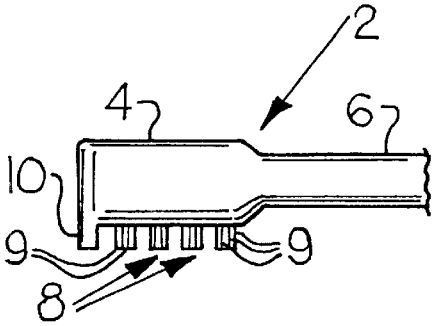
FIG. 5 is an alternative configuration of a head portion of the tongue cleaning device of FIG. 1.

The head portion 4 shown in FIG. 5 also preferably carries a lip 10 downwardly depending from a front edge thereof. The lip 10 extends across the full length of the head portion 4 (dimension "B") and acts as a collector of loosened debris not collected by the bristles 9 themselves which accumulates as the device 2 is used. This accumulated material is also rinsed with water away from the lip 10 after each pass along the tongue.

In order to provide improved access to the convex surface of the back of the tongue, the handle portion 6 is formed in an arcuate shape as shown in FIG. 1. A plane parallel to the top surface of the head portion 4 and parallel to the ends of the bristle tufts 8 defines an angle "A" with the longitudinal axis of a rear gripping section 7 of the handle portion 6, FIG. 1. Angle "A" is preferably between 10°–20° to better accommodate the convexity of the back surface of the tongue. The bend point is formed at a dimension "D" from the front of the head portion 4 and may range between 1–2 inches. The handle 6 is preferably rigid so as to resist bending as pressure is applied downwardly against the tongue during use.

The stiffness or softness of the bristles 9 can be varied by varying the diameter of the individual strands, as well as the number of bristles 9 in each bristle tuft 8. The tongue cleaning device 2 is injection molded from a thermoplastic material such as polypropylene or the like and the bristles 9 may be of a conventional, nylon material.

Figure 11:
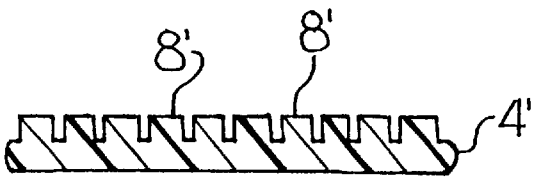
FIG. 11 is a cross-sectional view of the head portion of the device of FIG. 10 taken along lines XI—XI in FIG. 10.
Figure 9:
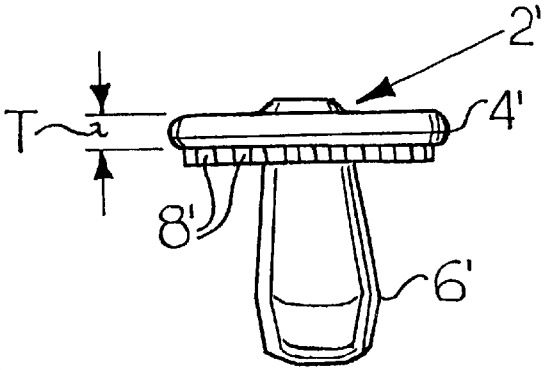
FIG. 9 is a front elevational view of the device of FIG. 6.
Figure 10:
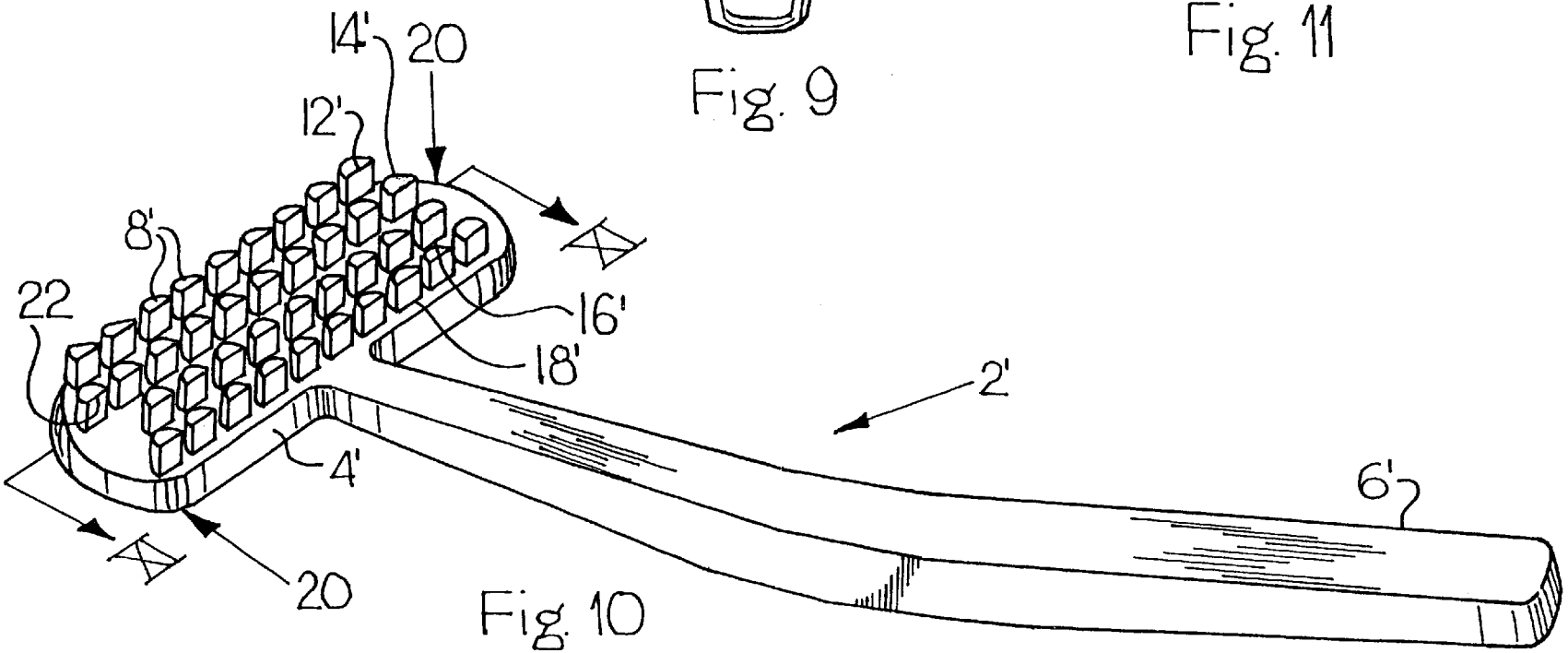
FIG. 10 is a top perspective view of the device of FIG. 6 with an underside of the head portion of the device facing upward.

As stated above, the bristles 9 may be formed in bristle tufts 8 comprising a plurality of individual bristle strands affixed to the head portion 4 in the same manner as is a conventional toothbrush. FIGS. 6–11 show a second embodiment of the device 2, discussed previously, and designated with reference numeral 2'. The device 2' is substantially similar to the device 2 discussed hereinabove, with the primary difference between the first and second embodiments being that the bristle tufts 8 are replaced by solid posts 8' that are injection molded integrally with the head portion 4' as illustrated in cross section in FIG. 11. As will be appreciated by those skilled in the art, integral injection molding of the posts 8' with the head portion 4' in the device 2' would lower the cost of these devices. Referring in particular to FIGS. 10 and 11, it is apparent that the posts 8', the head portion 4' and the handle 6' are formed as a unitary, one-piece unit. The head portion 4' is preferably formed with rounded ends 20 instead of the rectangular shape of the head portion 4 of the device 2 discussed previously. In the device 2', rows 12', 14', 16' and 18' are substantially parallel to each other and substantially parallel to the longitudinal axis of the head portion 4'.

As stated, the head portion 4' is substantially rectangular in plan view with rounded ends 20. As was the case with the device 2, the head portion 4' of the device 2' has a longer side dimension or length dimension "B'" in FIG. 8 of about 1¼ inches to 1½ inches. Similarly, the head portion 4' of the device 2' has a shorter side dimension or width dimension "C'" in FIG. 8 of about ½ inch. An overall height or thickness dimension "H'" of the head portion 4', which includes a thickness dimension "T" (shown in FIG. 9) of the head portion 4' and a length dimension "L'" of the posts 8', is less than about ¼ of an inch. Hence, the thin profile of the head portion 4' of the device 2' represented by dimension "H'" is even thinner than the device 2 discussed previously, and is made possible by the integral injection molding of the posts 8' with the head portion 4'. The thickness dimension "T" of the head portion 4' of the device 2' is, for example, about 0.147 of an inch and the length dimension "L'" of the posts 8' is about 0.070 of an inch. The device 2' has an overall length dimension represented by dimension "O" in FIG. 8 of between about 5 to 5¼ inches. The handle portion 6' of the device 2' includes the rear gripping portion 7. The rear gripping portion 7 has an end thickness dimension represented by dimension "E" in FIG. 6 of about ¼ inch and is generally slightly larger in dimension than dimension "H'" of the head portion 4'. The device 2' is operated in the same manner as the device 2 discussed previously. Furthermore, the device 2' is preferably injection molded from polymeric material such as polypropylene and the like wherein the head portion 4', the posts 8' and the handle portion 6' are formed as a unitary structure.

Figure 12:
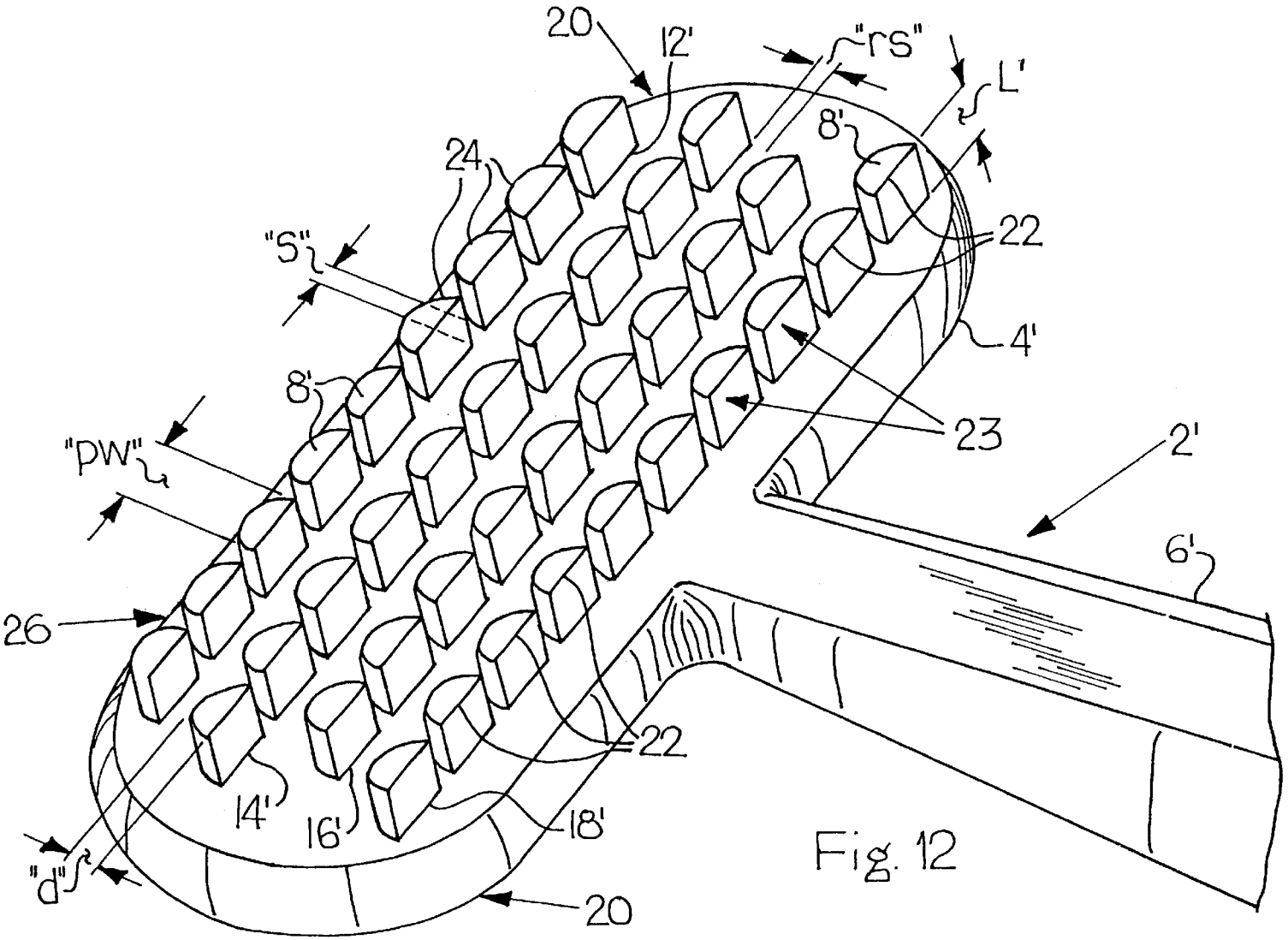
FIG. 12 is a top perspective view of the device of FIG. 6 with the underside of the head portion of the device facing upward and showing further details of the underside of the head portion.

Referring now to FIG. 12, the dimensions of the posts 8' arranged in rows 12', 14', 16' and 18' will be discussed in greater detail. Generally, the head portion 4' is substantially rectangular in shape with rounded ends 20. The posts 8' preferably further include a flat rear scraping edge 22 having a comer radius of about 0.005 of an inch. The comer radius of scraping edge 22 ensures that when the device 2' is in use, the head portion 4' will not have any sharp edges that could cut the soft tissue of the mouth and tongue. The posts 8' preferably extend substantially perpendicular directly from a lower surface of the head portion 4'. The posts 8' preferably have a substantially planar work surface 23 facing the direction of use of the device 2' (i.e., toward the handle portion 6'). The planar work surface 23 extends perpendicular relative to the lower surface of the head portion 4'. The flat scraping edge 22 for each of the posts 8' is formed by the planar work surface 23 at the tip of each of the posts 8'.

Referring now to FIG. 12, the dimensions of the posts 8' arranged in rows 12', 14', 16' and 18' will be discussed in greater detail. Generally, the head portion 4' is substantially rectangular in shape with rounded ends 20. The posts 8' preferably further include a flat rear scraping edge 22 having a corner radius of about 0.005 of an inch. The corner radius of scraping edge 22 ensures that when the device 2' is in use, the head portion 4' will not have any sharp edges that could cut the soft tissue of the mouth and tongue.

Figures 6, 7, 8:
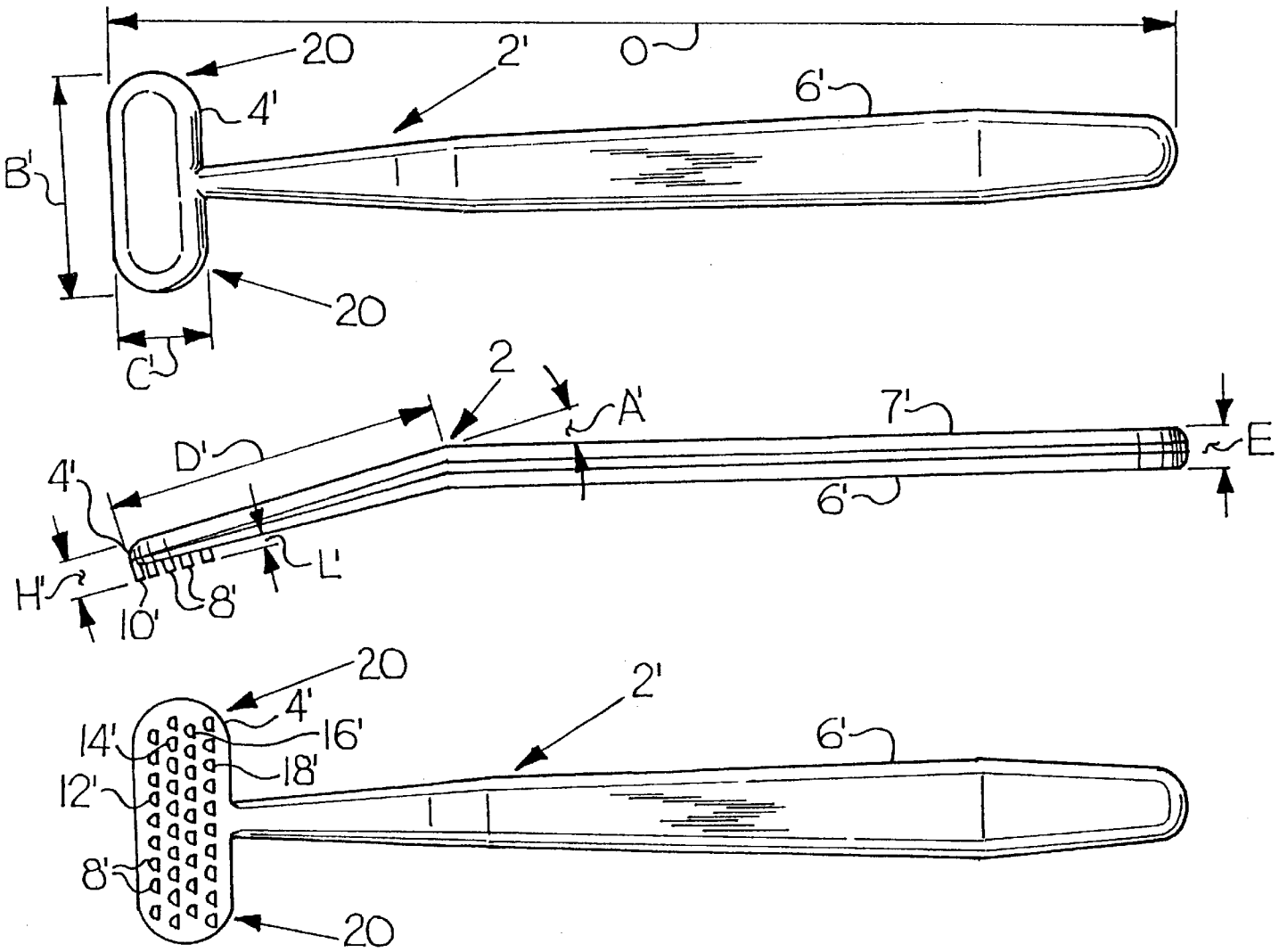
FIG. 6 is a longitudinal side view of a second embodiment of the tongue cleaning device of the present invention.
FIG. 7 is a bottom plan view of the device of FIG. 6.
FIG. 8 is a top plan view of the device of FIG. 6.

As stated previously, the posts 8' have a length dimension "L'" of about 0.070 of an inch. The posts 8' each preferably have a depth dimension represented by dimension "d" in FIG. 12, which may be, for example, about 0.0438 of an inch, which is typically measured at the distal end of the respective posts 8' in FIG. 12. The posts 8' in rows 12', 14', 16' and 18' are separated by spacing in each of the rows which is represented by dimension "s" in FIG. 12. Dimension "s" in FIG. may preferably range between about 0.010 to 0.012 of an inch. The rows 12', 14', 16' and 18' are separated by spacing between the rows which is represented by dimension "rs" in FIG. 12. Dimension "rs" in FIG. 12 may be, for example, about 0.065 of an inch. Returning to the individual posts 8', the respective posts 8' have a post width represented by dimension "pw" in FIG. 12. The posts width dimension "pw" is, for example, about 0.0967 of an inch at the widest point of the respective posts 8'. The posts 8' are each generally semicircular-shaped in plan view as shown in FIGS. 7, 10 and 12. Consequently, the posts 8' each have a convexly curved, semicircular front portion 24 facing a front edge 26 of the head portion 4' and the flat rear scraping edge 22 which faces rearwardly and forms the scraping edge of the device 2', as shown in FIG. 12. The semicircular front portion 24 of each of the posts has a radius of about 0.044 of an inch. The dimensions discussed hereinabove for the posts 8', spacing "s" between the posts 8' and the row spacing "rs" between rows 12', 14', 16' and 18' are merely illustrative and, of course, can be modified without departing from the scope of the present invention.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limited to the scope of the invention which is to be given the full breadth of the appended claims and any and all equivalents thereof.

I claim:

1. A device for cleaning a tongue, comprising:

an elongated member including a substantially rectangular head portion with rounded ends;

a plurality of rigid posts integrally molded with the head portion and each extending substantially perpendicular directly from a lower surface of the head portion, wherein a total length of the posts plus a thickness of the head portion is less than about ¼ of an inch, and wherein the posts each include a planar work surface; and an elongated handle portion extending from the head portion and aligned such that a longitudinal axis of the handle portion is transverse with a longitudinal axis of the head portion, wherein the work surface for each of the posts faces the handle portion, wherein the posts are spaced apart and arranged in a plurality of substantially parallel rows on the head portion, wherein the posts in each of the rows are offset with the posts of the next adjacent row, wherein the rows of posts are arranged substantially parallel with the longitudinal axis of the head portion, and wherein each of the posts includes a flat scraping edge formed by the planar work surface at the tip of the posts.

2. The tongue cleaning device of claim 1, wherein the handle portion is arcuate in shape.

3. The tongue cleaning device of claim 2, wherein the handle portion defines an angle of between about 10°–20° with a plane defined by a top surface of the head portion.

4. The tongue cleaning device of claim 1, wherein the posts have distal ends terminating in a common plane.

5. The tongue cleaning device of claim 4, wherein the common plane is spaced from the lower surface of the head portion by about 0.070 of an inch.

6. The tongue cleaning device of claim 1, wherein the device is injection molded as a unitary piece from polymeric material.

7. The tongue cleaning device of claim 6, wherein the polymeric material is polypropylene.

8. The tongue cleaning device of claim 1, wherein the substantially parallel rows of posts are spaced apart by about 0.065 of an inch.

9. The tongue cleaning device of claim 1, wherein the posts have a post width of about 0.0967 of an inch.

10. The tongue cleaning device of claim 1, wherein the posts have a post depth measured at a distal end thereof of about 0.0438 of an inch.

11. The tongue cleaning device of claim 1, wherein the posts in each row are separated from the next adjacent post in the row by spacing of between about 0.010 and 0.012 of an inch.

12. A device for cleaning a tongue, comprising:

an elongated member including a substantially rectangular head portion with rounded ends;

a plurality of rigid posts integrally molded with the head portion and each extending substantially perpendicular directly from a lower surface of the head portion, wherein a total length of the posts plus a thickness of the head portion is less than about ¼ of an inch, and wherein the posts each include a planar work surface;

an arcuate, elongated handle portion extending from the head portion and aligned such that a longitudinal axis of the handle portion is transverse with a longitudinal axis of the head portion; and a lip downwardly depending from a font edge of the head portion for retaining accumulated debris, wherein the work surface for each of the parts faces the handle portion, wherein the posts are spaced apart and arranged in a plurality of substantially parallel rows on the head portion wherein the posts in each of the rows are offset with the posts of the next adjacent row, wherein the rows of posts are arranged substantially parallel with the longitudinal axis of the head portion, and wherein each of the posts includes a flat scraping edge formed by the planar work surface at the tip of the posts.

13. The tongue cleaning device of claim 12, wherein the handle portion defines an angle of between about 10°–20° with a plane defined by a top surface of the head portion.

14. The tongue cleaning device of claim 12, wherein the posts have distal ends terminating in a common plane.

15. The tongue cleaning device of claim 14, wherein the common plane is spaced from the lower surface of the head portion by about 0.070 of an inch.

* * * * *

UNITED STATES PATENT AND TRADEMARK OFFICE

CERTIFICATE OF CORRECTION

PATENT NO. : 6,402,768 B1
DATED : June 11, 2002
INVENTOR(S) : Gary M. Liebel

It is certified that error appears in the above-identified patent and that said Letters Patent is hereby corrected as shown below:

Column 4,
Between lines 30 and 31, insert the following paragraph:

-- As shown in Figs. 7 and 10, the posts 8' in each of the rows 12', 14', 16' and 18' are offset with respect to the posts 8' of the next adjacent row. This orientation of posts 8' in rows 12', 14', 16' and 18' is a variation of the grouping of bristle tufts 8 discussed hereinabove in connection with the device 2, and also ensures proper and optimal cleaning as the head portion 4' is moved in a direction coincident with the longitudinal axis of the handle 6'. Of course, the device 2' may have rows 12', 14', 16' and 18' of posts 8' arranged in the grouping shown in Fig. 2.
In the device 2', rows 12' and 16' preferably have nine posts each and rows 14' and 18' preferably have ten posts each. The rows 12', 14', 16' and 18' are preferably arranged substantially parallel to each other and substantially parallel to the longitudinal axis of the head portion 4'. The device 2' may optionally include the lip 10 downwardly depending from the front edge of the head portion 4', as shown in Fig. 5 and previously discussed in connection with the device 2. --

Line 36, "a comer radius" should read -- a corner radius --.
Line 36, "The comer radius" should read -- The corner radius --.
Delete paragraph between lines 48-56.
Line 65, "in FIG. may" should read -- in FIG. 12 may --.

Column 6,
Line 38, "from a font edge" should read -- from a front edge --.

Signed and Sealed this

Nineteenth Day of November, 2002

*Attest:*

*Attesting Officer*

JAMES E. ROGAN
*Director of the United States Patent and Trademark Office*